United States Patent [19]

King

[11] Patent Number: 5,014,487

[45] Date of Patent: May 14, 1991

[54] RACK BEAMS AND METHOD OF MAKING SAME

[75] Inventor: John R. King, West Bloomfield, Mich.

[73] Assignee: S&K Enterprises, Inc., Detroit, Mich.

[21] Appl. No.: 429,971

[22] Filed: Nov. 1, 1989

[51] Int. Cl.[5] ..... A47F 5/01; E04C 3/07

[52] U.S. Cl. ..... 52/731; 211/191

[58] Field of Search ..... 211/135, 186, 41, 177, 211/191; 52/731, 732; 280/797, 798; 108/157

[56] References Cited

U.S. PATENT DOCUMENTS

| | | | |
|---|---|---|---|
| 3,234,704 | 2/1966 | Burgess | 52/731 |
| 3,587,483 | 6/1971 | Konstant | 211/191 X |
| 3,611,666 | 10/1971 | Poyser | 52/731 |
| 4,216,729 | 8/1980 | Schrader | 211/191 X |
| 4,221,097 | 9/1980 | Dingler | 52/731 |
| 4,760,682 | 8/1988 | King | 52/731 |

*Primary Examiner*—John E. Murtagh

*Attorney, Agent, or Firm*—Harness, Dickey & Pierce

[57] ABSTRACT

A hollow, tubular, elongated beam is made by roll-forming an elongated strip of sheet metal into a generally rectangular cross-section shape with its opposite edge portions overlapped to form a double ply beam wall along one side of the beam. The plies are adhesively secured together by an adhesive material inserted between them. The sheet metal is initially rolled into a U-shaped channel having a base and opposite walls. An integral, interior ledge is formed in, and extends along the length of, one of the channel walls. Then, the edge portion of the opposite channel wall is bent to form an inner ply that overlaps and closes the open channel, to form the tubular shape, with its free edge abutted against the ledge. Next, the free edge of said one channel wall is bent to form an outer ply around and overlapping the inner ply, with the abutted inner ply free edge and ledge serving as a support for the bending of the outer ply. The adhesive is inserted between the plies when the outer ply is bent.

9 Claims, 1 Drawing Sheet

RACK BEAMS AND METHOD OF MAKING SAME

BACKGROUND OF INVENTION

This invention relates to a roll formed, sheet metal beam which is used, primarily, in a heavy-duty, load-bearing rack, such as the type of open-frame racks used for supporting pallets and the like.

A pallet rack or heavy-duty support frame is disclosed in my U.S. Pat. No. 4,760,682 issued Aug. 2, 1988, for a "Tubular Rack Beam and Method of Making Same". By way of example, a rack frame is generally formed of a number of upright posts which are interconnected by horizontal beams. The beams form shelves upon which heavy loads may be positioned. For example, a loaded pallet or large, heavy containers, may be placed upon the horizontal beams and supported thereon using material handling equipment such as fork trucks or the like. Alternatively, slats or shelf forming boards may be positioned upon and extended between opposing beams to form shelf-like surfaces for supporting loads.

Typically, the vertical posts are made of square or rectangular in cross-section tubes formed of steel or the like sheet metal. The horizontal beams which interconnect the posts, also are usually formed of strips of sheet metal, such as steel, which are bent or roll formed into tubes. These tubes may be generally square or rectangular in cross-section or have a cross-section which generally approximates a square or rectangular cross-section. In the past, one form of beam was made of two channel long channels which were arranged with their legs interfitting. The two channels were welded together to form a unitary beam. In my above-mentioned U.S. Pat. No. 4,760,682, the beam is disclosed as being formed of two, generally channel shaped pieces, which are interlocked together frictionally or mechanically and, also, are secured together by an adhesive.

Another form of prior beam has been made of a single strip of sheet metal which was bent or roll formed into a tubular shape. The opposite edges of the strip were either overlapped and welded together or were bent into edge beads or flanges which were arranged adjacent one another and welded together.

The invention herein is particularly concerned with improving a single strip sheet metal type beam so as to improve its anticipated strength while simultaneously reducing the cost of manufacturing this beam. Since substantial quantities of this type of beam is used in industry, particularly in storage facilities in factories or in warehouses, an increase in the strength of such beams, which permits using a smaller cross-section or a thinner gage material, can substantially, reduce costs. Likewise, costs can be reduced by the elimination of the usual welding procedures.

Thus, this invention is concerned with improving the manufacture and construction of a tubular, sheet metal beam which is typically roll formed out of a long, single strip of sheet metal.

SUMMARY OF INVENTION

This invention contemplates forming a hollow, tubular, beam, which is roughly square or rectangular in cross-section, by roll forming or similarly bending an elongated strip of sheet metal. The strip is initially bent into a channel shape cross-section having a base and two opposed legs. One of the legs has a shoulder or ledge impressed in it and running along its length. The opposite leg has an edge flange which abuts against the shoulder when the opposite leg is bent, roughly in half, so that its outer half portion forms an inner ply or cover which closes the channel. The leg with the abutment or shoulder is bent, roughly in half, so that it folds over and overlies the inner ply. This provides a two ply, double thick, wall that closes the channel. Preferably, the free edge of the outer ply is bent into an edge flange which is shaped generally like a hook. The hook extends over and mechanically interlocks with a bulge or engagement portion formed on the opposite wall. Adhesive is introduced between the two ply forming wall portions when they are bent so that the adhesive, upon curing, laminates the two plies together.

The system of roll forming the strip of sheet metal, first, into a channel and, secondly, bending the edge portions of the side walls of the channel to form the two ply closure wall, results in a closed tube having one double thick wall which provides substantial strength beyond that normally anticipated in this type of tube construction. In addition, the engagement between the free edge of the inner ply bent portion against the ledge or shoulder provides a fulcrum or support around which the outer ply is bent so as to enable the roll forming of the outer ply without the need of complicated or expensive dies or mandrels.

One object of this invention is to provide a rolled tubular beam which is unitized by adhesive rather than by welding, to thereby reduce the overall cost of manufacturing the product. In addition, the unitized construction, with the laminated, two ply wall, has a substantially increased strength, as compared with prior beams, for any particular gage metal and cross-sectional size and shape.

A further object of this invention is to provide a unitized, tubular, beam having a two ply wall whose opposite edges are mechanically interlocked, in addition to utilizing adhesive fastenings, for increasing the strength and permitting relatively inexpensive and speedy manufacturing procedures.

An additional object of this invention is to provide a manufacturing technique which accommodates to the slight variations in width of commercially available steel strips which are utilized in the manufacture of hollow, tubular beams. Thus, slightly irregularly sized strips may be used in manufacturing without the necessity of trimming their edges to accurate dimensions prior to rolling.

These and other objects and advantages of this invention will be become apparent upon reading the following description of which the attached drawings form a part.

DETAILED DESCRIPTION

Figure 1:
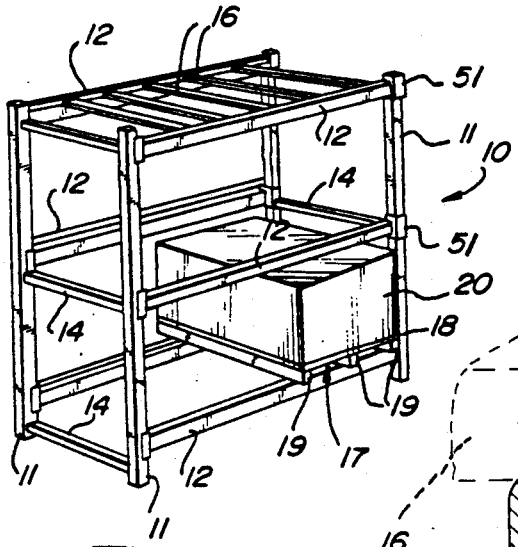
FIG. 1 is a perspective view of a pallet rack or storage support frame with a single, container loaded pallet, positioned on the lower portion of the rack.

FIG. 1 schematically illustrates a typical pallet rack 10 or similar frame-type of storage shelving unit. The rack or frame is formed of four vertical frame posts 11 that are joined together by horizontal front and rear beams 12 and horizontal size beams or braces 14. These posts may be further connected together by angularly arranged braces that extend from one post to another. However, these have been omitted for simplicity of disclosure. Slats 16 may extend between the beams 12.

Usually, the posts 10 are made of metal tubes which may be square or generally rectangular in cross-section. Also, tubes of this type are commonly made in an open, C-shaped cross-section. The horizontal side beams or braces 14 are similarly made of square or rectangular cross-section tubing or C-shaped bent tube-like members.

Figure 3:
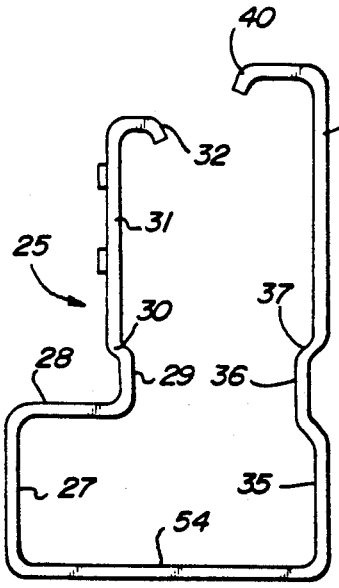
FIG. 3 is an end view of the U-shaped channel which is roll-formed from a strip of sheet metal to form the initial beam configuration.

This invention is particularly concerned with the horizontal front and rear beams 12 and the physical construction and manufacturing procedures for these beams. Turning to FIG. 3, the beam is roll-formed or bent from an elongated, relatively narrow sheet metal strip, such as steel stripping. The strip is bent into a U-shape having a base 24 and wide sidewalls 25 and 26. The sidewall 25 has a lower wall portion 27 which forms one side wall of the finished beam. In addition, it may be bent to form a step-like tread 28 and a step-like riser portion 29 upon which the slats 16 or larger shelving boards (not illustrated) may be positioned. The upper end of the riser portion is bent outwardly along its length to form an outer bend 30.

The upper half or outer end portion of the sidewall 25 forms an inner ply 31 which is one of the two plies that constitutes the closure wall of the beam. As illustrated in FIG. 3, the free edge of the inner ply portion 31 is bent into an edge flange 32 which is somewhat curved in shape.

The opposite side wall 26, of the channel shape, has a lower half or inner portion 35 which forms the side wall of the beam. In addition, it is provided with a bent, shallow groove 36 which extends its length and which provides, at is upper end, a shoulder or ledge 37. The wall continues upwardly, forming an outer ply portion 39 whose free edge terminates in a hook-like edge flange 40.

Figure 4:
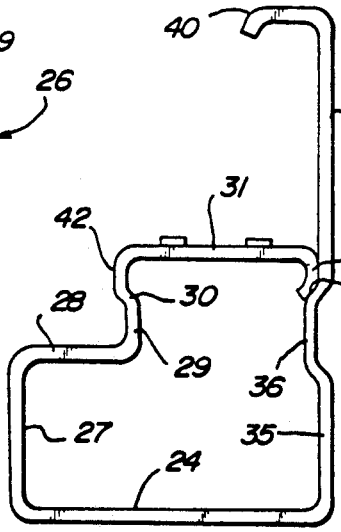
FIG. 4 is an end view, similar to FIG. 3, showing one of the side walls of the U-shaped channel bent horizontally to form the inner ply of the closure wall of the beam.

Referring to FIG. 4, following the formation of the U-shape configuration shown in FIG. 3, the inner ply portion 31 is bent so as to cover the open mouth of the channel. Its bent edge flange 32 engages against the shoulder 37 of the opposite wall. Also, in the course of bending the inner ply, the juncture of the inner ply with its integral wall forms a bulge portion 42 which acts as part of a fastening means.

Figure 5:
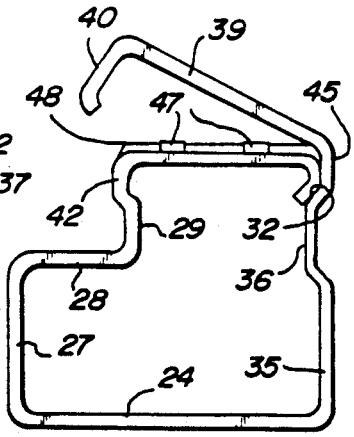
FIG. 5 is a view similar to FIG. 4, showing the outer ply forming portion of the opposite wall of the channel being bent downwardly into its wall forming position and with adhesive located between the two plies.

Next, as illustrated in FIG. 5, the outer flange portion 39 is bent over the inner ply, forming a bent edge strip 45. In the bending of the outer ply, the engagement between the shoulder or ledge 37 and the inner ply edge flange 32 provides a fulcrum or support area around which the bending can be performed. The bending of the outer ply continues until its hook-like flange 40 resiliently snaps over the bulge or fastening portion 42 for mechanically interlocking the outer ply in place.

Figure 6:
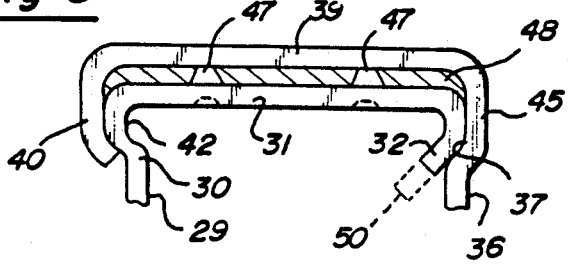
FIG. 6 is an enlarged, fragmentary view, showing the two plies of the beam in adjacent relationship with adhesive between them. The space between the plies is greatly exaggerated for illustration purposes.

When the outer ply 39 is bent, adhesive 48 is applied upon the upper surface of the inner ply 31. The two ply surfaces are spaced apart by embossments or bumps 47 which are punched or otherwise formed in the lower ply 31 (see FIG. 6). The layer of adhesive may be applied upon the surface of the inner ply 31 at or just prior to bending the outer ply 39 so that when the outer ply is parallel to the inner ply and its hook-like flange snaps over and mechanically interlocks with the bulge 42, the adhesive fills the space between the plies. Then the adhesive may cure and secure the adjacent faces of the plies to each other.

Since the widths and thicknesses of commercially available steel strip vary slightly, such slight variations can be accommodated by permitting the excess material or run-out to accumulate on the edge flange 32. This run-out 50 is shown in dotted lines in FIG. 6 to illustrate that the excess material can be accommodated by variations in the length of the edge flange 32 without adversely effecting the construction. This eliminates the need for accurately trimming the edge before roll forming or the need for accurate control of material thickness.

Figure 2:
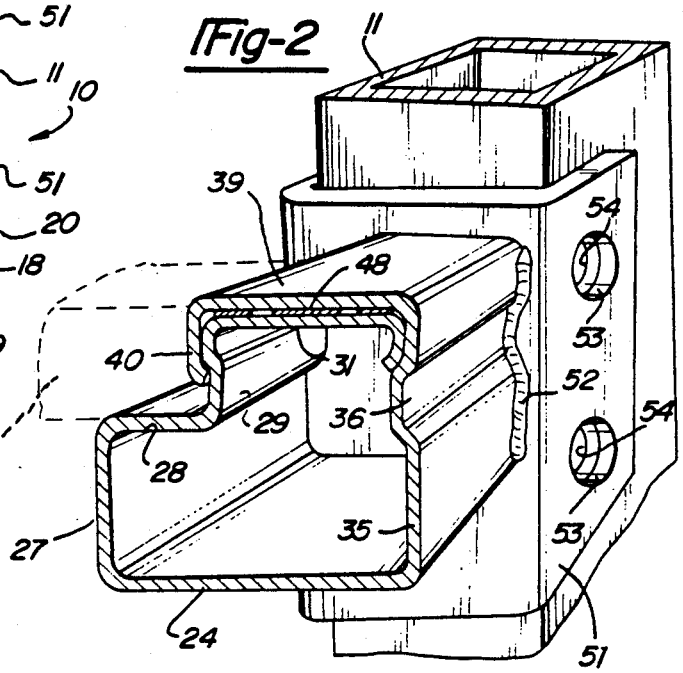
FIG. 2 is an enlarged, fragmentary view of an end portion of the beam and shows its connection to the vertical post of the rack.

One common way of fastening the horizontal beams of a pallet rack or similar frame to the vertical posts is by utilizing a U-shaped or angle shaped brackets 51 (see FIG. 2). These brackets are sized and shaped to fit around the vertical posts. The adjacent ends of the beams may be fastened to the bracket surfaces by means of a suitable weld 52. The brackets are provided with holes 53 which align with preformed bolt holes 54 in the posts. Consequently, bolts or pins can be inserted through the aligned holes for positioning and fastening the brackets in place at desired heights. The heights can be adjusted by removing the bolts, realigning the brackets with different holes in the posts and reinserting the bolts.

This invention may be further developed within the scope of the following claims. Thus, it is desired that the foregoing description be read as illustrative of an embodiment of the invention.

Having fully described an embodiment of this invention, I now claim:

1. A tubular beam formed of a single elongated bent sheet metal strip, comprising:

said sheet metal strip being bent into a roughly rectangular in cross section tube having a base, integral side walls, and a two ply closure wall formed of the overlapping opposite edge portions of the sheet metal strip;

one of said edge portions forming an inner ply which extends from its side wall to the opposite side wall and having a flange on its free end in frictional engagement with an inner surface of the opposite side wall, and the other of said edge portion forming an outer ply that overlaps the inner ply with an end flange frictionally engaging a bulge portion in an outer surface of the opposite side wall;

the overlapping adjacent faces of the two plies being slightly spaced apart, and an adhesive material positioned within the space for adhesively laminating the plies together;

whereby the tube forms a unitary beam with a two ply laminated wall and three single ply walls.

2. A tubular beam as defined in claim 1, and including integral means formed on at least one of the plies for slightly spacing the two plies apart for the reception of adhesive material between them.

3. A tubular beam as defined in claim 1, and including said means for spacing the plies apart, including integral embossments formed on one of the plies and extending toward and engaging the opposite ply.

4. A construction formed of an elongated bent sheet metal strip, comprising:

said sheet metal strip being bent into a roughly rectangular in cross section tube having a base, integral side walls, and a two ply closure wall formed of the overlapping opposite edge portions of the sheet metal strip;

one of said edge portions forming an inner ply which extends from its side wall into engagement of its free edge with the opposite side wall, and the other of said edge portion forming an outer ply that overlaps the inner ply;

a substantially continuous, narrow flange formed on the free edge of said inner ply, and a substantially continuous, bent ledge formed on, and extending along the length of, the side wall that the inner ply free edge engages, whereby the inner ply edge flange is arranged in engagement against the ledge;

the overlapping adjacent faces of the two plies being slightly spaced apart, and an adhesive material positioned within the space for adhesively laminating the plies together;

whereby the tube forms a unitary beam with a two-ply laminated wall and three single-ply walls.

5. A construction as defined in claim 4, and including a substantially continuous, narrow hook-like flange formed on the free edge of the outer ply, with said hook-like flange extending over and engaging the area defining the juncture between the inner ply and its integral side wall.

6. A construction as defined in claim 5, and including a bulge-like engagement means formed on the area defining the juncture between the inner ply and its integral side wall, and said hook-like flange being engaged with and mechanically interlocking with said bulge-like engagement means 7. A construction as defined in claim 6, and including a step-like strip formed in the side wall, with which the inner ply is integral, between the bulge-like engagement means and the base of the tube, for seating the edges of articles to be supported by the beam.

8. A construction as defined in claim 7, and including said beam normally being arranged substantially horizontally with the two ply wall and the base being arranged in generally horizontal planes and the side walls being in generally vertical planes 9. A construction as defined in claim 8, and including said two ply wall forming the uppermost wall of the beam so that the side walls and base of the beam are of a single ply.

* * * * *